United States Patent [19]

Litterscheidt et al.

[11] Patent Number: 4,808,220

[45] Date of Patent: Feb. 28, 1989

[54] PROCESS FOR THE PREPARATION OF REFINED FERROMANGANESE

[75] Inventors: Hans Litterscheidt, Essen; Manfred Rähder, Mettmann; Carl-Heinz Schütz, Duisburg; Richard A. Weber, Moers, all of Fed. Rep. of Germany

[73] Assignee: Thyssen Stahl AG, Duisburg, Fed. Rep. of Germany

[21] Appl. No.: 162,539

[22] Filed: Mar. 1, 1988

[30] Foreign Application Priority Data

Mar. 11, 1987 [DE] Fed. Rep. of Germany ..... 3707696

[51] Int. Cl.[4] ..... C21C 7/00

[52] U.S. Cl. ..... 75/51.7; 75/51.6; 75/59.22

[58] Field of Search ..... 75/51.7, 59.22, 51.6, 75/51.7

[56] References Cited

U.S. PATENT DOCUMENTS 3,771,998 11/1973 Knuppel ..... 75/59.22
3,854,932 12/1974 Bishop ..... 75/59.22
4,358,314 11/1982 Normanton ..... 75/59.22
4,365,992 12/1982 Sieckman ..... 75/51.6
4,422,873 12/1983 Yamada ..... 75/51.7
4,604,138 8/1986 Hoffken ..... 75/59.22

*Primary Examiner*—Peter D. Rosenberg
*Attorney, Agent, or Firm*—Sprung Horn Kramer & Woods

[57] ABSTRACT

The invention relates to a process for the preparation of low-carbon and low-silicon ferromanganese (refined ferromanganese) by blowing with pure oxygen in a converter ferromanganese of high carbon content (high-carbon ferromanganese) produced in a blast furnace. The characterizing feature of the invention is that in an oxidation phase oxygen is blown from above with a top blowing lance on to the melt of high-carbon ferromanganese melt, while at the same time an inert stirring gas is blown through tuyeres into the melt below its level, and on termination of oxygen top blowing, in an immediately following reduction phase, solid reducing agents and lumps of lime are added to the melt to recover the slagged manganese.

19 Claims, 1 Drawing Sheet

PROCESS FOR THE PREPARATION OF REFINED FERROMANGANESE

Figure 1:
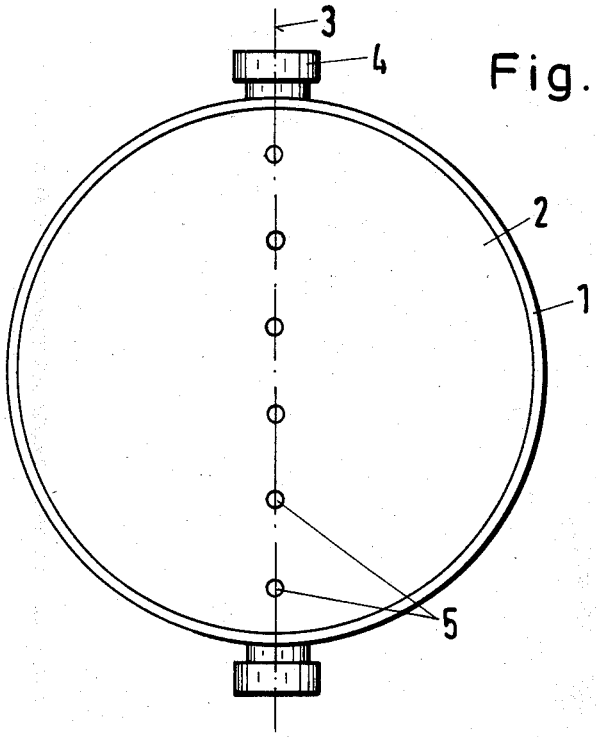

The invention relates to a process for the preparation of low-carbon and low-silicon ferromanganese (refined ferromanganese) by blowing high-carbon ferromanganese produced in a blast furnace.

It is known to blow low-carbon ferromanganese (refined ferromanganese) with oxygen in a converter by means of shell-gas tuyeres without any substantial formation of a high-manganese-oxide slag, the alloy melt being heated to a temperature of over 100° C. above the melting zone prior to the oxygen being blown in, approximately 15 $Nm^3$ of oxygen being blown into the ferroalloy for each 1% of carbon to be removed and each tonne of alloy. Heating above the melting range is performed by adding present or additional oxygen-related metals or their alloys, e.g., silicon metal, ferrosilicon, aluminium at the beginning of the blowing period and oxidizing them with oxygen. The working temperature of the alloy melt is maintained constant by the addition of solid cooling material, e.g., reflux metal of the same kind, slag-containing metal of the same kind, refined ore, prereduced ore or the like (German Patent Specification No. 2201388).

In a further development of this process, the temperature of the alloy melt is raised to a temperature of above 1650° to 1900° C. by blowing in oxygen without the addition of coolants, a high-melting manganese oxide phase being formed. This phase is then reduced out, on the one hand by the introduction of lime, and on the other by the addition of solid reducing agents, such as silicon and aluminium and/or their alloys (German OS No. 2531034).

According to a further suggestion, up to about 20% solid alloy metal is added to the alloy melt, and the quantity and speeds of supply of oxygen are so selected that the decarbonization reaction takes place at focal spots over the shell-gas tuyeres in the jacket (German Patent Specification No. 2540290). German OS No. 2901707 also discloses a process for the preparation of ferromanganese by blowing in an oxidizing gas, steam and/or an inert gas below the level of the metal melt by means of immersed tuyeres which are protected by the introduction of a peripheral cooling fluid discharging into the bath to be blown. In this process pure oxygen up to an intermediate carbon content of 2 to 3.5% is blown through the tuyeres until the bath to be blown reaches a temperature between 1650° and 1750° C. Up to a maximum carbon content of 1.6% pure oxygen and steam are blown through the tuyeres separately and simultaneously mixed, with or without inert gas, the volumetric proportions of the pure oxygen being at most 50%, of steam at least 30% and of inert gas at least 70% of the total particular gas volume blown, and such proportions being regulated to constantly maintain the temperature of the ferromanganese bath between 1670° and 1700° C.

German OS No. 3001941 also discloses a process for the preparation with an oxidizing agent in a reactor of ferromanganese having a carbon content of 0.5 to 2% by decarbonization of a ferromanganese melt with a carbon content of 3 to 8% and up to 7% silicon. In this process the oxidizing agent, e.g., oxygen, is introduced into the lower zone of the melt, which is kept at an atmospheric overpressure, preferably of 1.5 to 15 bar. A temperature-regulating gas in the form of carbon dioxide, air, nitrogen, argon and/or steam can be added to the oxidizing agent.

All the aforedescribed processes operate with shell-gas tuyeres in the jacket, through which the oxygen required for the decarbonization reaction is blown in. The tuyeres are disposed below the surface of the bath and must therefore also be acted upon with coolants, such as hydrocarbons, to prevent them from burning back. These protective media are expensive and metallurgically unimportant and therefore represent a considerable costs factor.

Expensive evaporation and heating devices and additional control stations are also required for such gases. Moreover, carbon-containing cooling gases lead to increased oxygen consumption and may also limit the attainable carbon content by their recarburizing effect.

Since the tuyere cross-sections must be dimensioned in accordance with the quantity of oxygen required for the blowing speed, similarly large quantities of inert gas (Ar, $N_2$) must flow through them during converter empty or turnround periods, and this adds further to the costs of the process.

Experience shows that blowing in oxygen through the converter base or below the bath surface leads to heavy local bath turbulences, which by erosion result in highly premature wear on the refractories of the converter base and the adjoining zones, causing additional expense on repairs and refractories.

Finally, U.S. Pat. No. 3 305 352 discloses a process for the preparation of ferromanganese having a carbon content of not more than 1.5% by oxygen top blowing. The process starts from a ferromanganese produced, for example, in a blast furnace, and having a minimum carbon content of 3% and a silicon content of up to 5%. This high-carbon ferromanganese is heated to a decarbonization temperature of at least 1550° C. Then oxygen is top blown in a quantity adequate to bring the melt to a temperature of about 1700° C., before the carbon has been reduced to 1.5%. The blowing operation is continued until the temperature of the melt has reached 1750° C. and is terminated after that temperature has been reached, a ferromanganese being obtained which has a carbon content of not more than 1.5%. One quarter of the total oxygen required can be blown to reach a decarbonization temperature of at least 1550° C. However, the melt can also be brought to this temperature by induction heating in an induction furnace.

This process has the advantage that operations can be performed in comparatively simple units basically known from steel production. However, a considerable disadvantage of the process is that at the end of the process a high proportion of high-manganese-oxide, high-melting slag is present, which requires high tapping and casting temperatures to ensure adequate metal/slag separation. This slag also represents a considerable loss of manganese, relected in a comparatively low metal/manganese yield.

It is an object of the invention to provide a process for the preparation of low-carbon and silicon-carbon (refined) ferromanganese by blowing with pure oxygen in a converter a high-carbon ferromanganese produced in a blast furnace, which uses the essential advantages of the known bottom blowing processes but obviates considerable disadvantages—i.e., enables production to be as low-energy, lost-free as possible without heavy lining wear.

The steps set forth in claim 1 are proposed to solve this problem.

On completion of the addition of solid reducing agents, the melt is cooled to casting temperature with material of the same nature, preferably in a cooling phase, while blowing gas continues to be blown in.

The tapping temperature can be adapted within wide limits to the requirements of casting technology. The quantity of bottom gas can be reduced by selection of the tuyere cross-section, the number and arrangement of the tuyeres, and also the regulation of the gas quantity determined by process parameters to the extent required to maintain the bath motion required for the individual process steps.

According to the invention in the oxidation phase the quantity of top blown oxygen is 1.50 to 4.0 $Nm^3$/min per tonne of high-carbon ferromanganese, preferably 2.5 to 3.5 $Nm^3$/min per tonne of high-carbon ferromanganese, and the quantity of stirring gas is 0.02 to 0.50 $Nm^3$/min per tonne of high carbon ferromanganese, preferably 0.02 to 0.15 $Nm^3$/min per tonne of high carbon ferromanganese. In the reduction and cooling phase, advantageously operations are performed with a quantity of stirring gas of 0.05 to 0.50 $Nm^3$/min per tonne of high-carbon ferromanganese.

The stirring gas used according to the invention in the oxidation phase is nitrogen, argon, carbon dioxide or waste gases, and in the reduction phase argon or nitrogen.

The solid reducing agents used in the reduction phase are preferably silicomanganese, ferrosilicon, silicon, aluminium or their alloys, in quantities of 5 to 15 kg of silicon or aluminium per tonne of high-carbon ferromanganese; the quantity of lime in lumps ranges between 10 to 40 kg per tonne of high-carbon ferromanganese, depending on the silicon content.

According to a further feature of the invention, manganese ore or filter dusts separated during the process are used both during and after the blowing phase for cooling, and the immediately following reduction phase is modified so that manganese is obtained both from the fresh slag and from the manganese ore to which the aforementioned other solid reducing agents are added.

In the cooling phase immediately following reduction, preferably refined ferromanganese is added in quantities of 40 to 350 kg per tonne of high-carbon ferromanganese, preferably 60 to 180 kg per tonne of high-carbon ferromanganese. However, manganese ore or filter dusts separated during the process can be substituted partly or wholly for refined ferromanganese as the coolant.

Dolomite and/or magnesite can be used as additional slag formers in quantities up to 40 kg per tonne of high-carbon ferromanganese and not only produce the required cooling effect but also afford special protection to the vessel refractory lining.

One important advantage of the process according to the invention for the preparation of low-carbon ferromanganese is the use of tuyeres which are disposed below the bath surface and produce a strong enough bath motion by the blowing-in of small quantities of stirring gas during and after the blowing process.

As a result, when decarbonization declines in the oxidation phase, an adequate bath-slag turnover is maintained, and in an immediately following reduction phase the high-manganese-oxide slags are enabled to be reduced out, so that at tapping the required metal/slag separation is obtained with an adequate degree of fluidity.

The production vessel used can be a conventional steel production converter in whose base according to the invention 2 to 20, preferably 6 to 10, tuyeres are disposed for blowing in stirring gas.

For the top blowing of the oxygen a water-cooled top blowing lance is used which is characterized by 3 to 10, preferably 4 to 6 nozzle apertures at the lance tip.

The blowing speed and lance height are adjusted in accordance with the course of decarbonization and also depend on the analysis of the high-carbon ferromanganese to be blown and the low-carbon ferromanganese to be produced.

The kind and nature of the stirring gas to be blown in beneath the bath are associated with the individual process stages.

The blowing are so arranged and dimensioned that they can be operated with comparatively small quantities of gas, thus avoiding the known disadvantages of shell-gas tuyeres operated by large gas quantities. Preferably the bottom tuyeres are arranged in the centre of the converter base in a row parallel with the axis of rotation of the converter or completely in that part of the converter base which is free from melt and slag when the converter is turned over. This enables an effective circulatory motion of the melt to be established, so that the metal and slag are always in intensive contact, without any increased wear on the refractory converter lining. The arrangement of the tuyeres in the converter base according to the invention also has the advantage that when the converter is turned over, the tuyeres are exposed and the quantity of stirring gas can be correspondingly reduced in this stage of the process. Another result is the avoidance of evaporation of the metal by atomization. The internal diameter of the converter base tuyeres is 3 to 12 mm, preferably 7 to 9 mm.

The advantages achieved by the invention are more particularly that:

due to the blowing of stirring gas into the melt, the quantity of inert gas can be determined in accordance with the quantities required for the individual phases, something which leads to a substantial reduction in inert gas consumption;

the tuyeres, altered as against known shell-gas cooled tuyeres, and the slagging practice lead to a considerable reduction in refractory wear, more particularly in the base zone;

there is no need to use expensive cooling gases, which moreover require complicated regulating and expensive evaporation devices;

the converter base construction is appreciably simplified by the insertion of simple tubular tuyeres;

the reduction and cooling phase immediately following the oxidation phase enables the tapping temperature to be adjusted as required within wide limits;

high yield losses in the slag are obviated.

A number of embodiments of the invention will now be described in detail.

EXAMPLE 1

120 700 kg of high-carbon ferromanganese having the following composition:

| | |
|---|---|
| 7.10% | C |
| 0.81% | Si |
| 79.30% | Mn |
| 0.120% | P |
| 0.014% | S |

-continued

| |
|---|
| residue Fe |

were introduced at a temperature of 1335° C. into a converter having a capacity of 140 tonnes.

The oxygen was blown on to the melt at a speed of 300 $Nm^3$/min using a top blowing lance with four nozzle apertures for about 27 minutes. At the same time argon was introduced into the melt through six bottom tuyeres at a speed of 6.3 $Nm^3$/min.

The oxygen supply through the lance was disconnected with a quantity of 8150 $Nm^3O_2$ of oxygen and the lance was withdrawn from the converter. Following the oxidation phase, 5838 kg of SiMn was introduced into the converter from above within 2 minutes. 2144 kg of lime was drawn into the converter with one minute's delay. During this reduction phase 12.6 $Nm^3$ of argon per minute were blown through the bottom tuyeres into the melt. Then the melt was cooled in the converter by means of coolants of the same nature to the tapping temperature of about 1580° C. The coolant consumption was 6902 kg of low-carbon ferromanganese. At the same time 4032 kg of dolomite lime were added as a slag former.

112 000 kg of low-carbon ferromanganese having the following analysis were tapped from the converter:

| | |
|---|---|
| 1.22% | C |
| 0.64% | Si |
| 82.20% | Mn |
| 0.120% | P |
| 0.010% | S |
| | residue Fe. |

About 10 500 kg of slag was deposited having the following composition:

| | |
|---|---|
| 19.7% | $Mn^{2+}$ |
| 23.6% | $SiO_2$ |
| 30.0% | CaO |
| 19.7% | MgO |
| | residue FeO, $Al_2O_3$. |

The yield of metal was 83.9%, the manganese yield being 88%.

EXAMPLE 2

127 400 kg of low-ferromanganese having the following analysis:

| | |
|---|---|
| 7.14% | C |
| 0.73% | Si |
| 79.2% | Mn |
| 0.120% | P |
| 0.013% | S |
| | residue Fe |

were introduced at a temperature of 1345° C. into a converter as in Example 1.

Then oxygen was blown on to the melt at a speed on 300 $Nm^3$/min using a top blowing lance with four nozzle apertures for about 26 minutes. At the same time argon was introduced into the melt through six bottom tuyeres at a speed of 6.3 $Nm^3$/min.

The oxygen supply from the top blowing lance was interrupted after 9000 $Nm^3O_2$ had been blown and the top blowing lance was withdrawn from the converter.

Then, similar to Example 1, the manganese oxide was reduced from the slag back into the melt. For this purpose 788 kg of Al and 2280 kg of lime were introduced into the converter from above, 10.5 $Nm^3$ of argon per minute being blown into the bath at the same time through the bottom tuyeres. After reduction had taken place, the melt in the converter was brought to a temperature of 1611° C. by a coolant of the same nature. For this purpose 11 820 kg of low-carbon coolant was required. At the same time 4284 kg of dolomite lime were added as slag former. 117 000 kg of low-carbon ferromanganese having the following analysis were tapped from the converter:

| | |
|---|---|
| 0.83% | C |
| 0.17% | Si |
| 82.70% | Mn |
| 0.150% | P |
| 0.010% | S |
| | residue Fe. |

About 11 100 kg of slag was deposited having the following composition:

| | |
|---|---|
| 19.3% | $Mn^{2+}$ |
| 12.4% | $SiO_2$ |
| 31.2% | CaO |
| 11.2% | $Al_2O_3$ |
| 18.3% | MgO |
| | residue FeO. |

The metal yield was 83.6%, the manganese yield being 87.4%.

The drawings show two preferred arrangements of the bottom tuyeres in the converter base.

Figure 2:
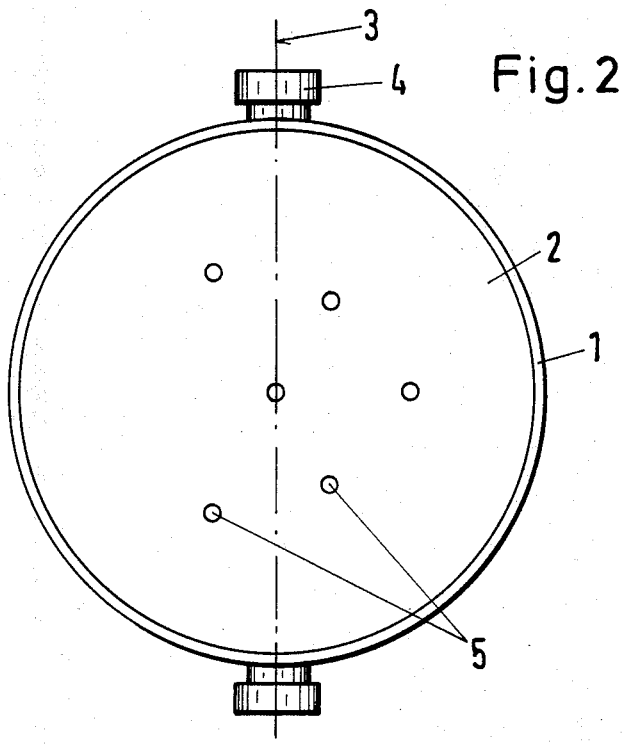

FIG. 1 is a diagrammatic plan view of a converter constructed with bottom tuyeres and FIG. 2 is a plan view of a converter having differently arranged bottom tuyeres.

In the embodiment illustrated in FIG. 1 the bottom tuyeres 5 are disposed in the centre of the converter base 2 in a row parallel with the axis of rotation 3 and in the central plane of the converter 1. The pivot pins have the reference 4.

In the embodiment illustrated in FIG. 2, the bottom tuyeres 5 are disposed in that part of the converter base 2 which is free from melt and slag when the converter 1 is turned over—i.e., the upper part of the converter base 2 in the turned-over condition of the converter 1. These arrangements of the bottom tuyeres 5 in the converter base 2 ensure that the bottom tuyeres 5 are exposed after the converter 1 has been turned over. At this stage of the process of the quantity of stirring gas can be correspondingly reduced. No atomization of slag and metal and therefore no evaporation of metal take place.

What is claimed is:

1. A process for the preparation of low-carbon and low-silicon ferromanganese (refined ferromanganese) by refining ferromanganese of high carbon content (high-carbon ferromanganese) produced in a blast furnace in a converter, comprising (a) in an oxidation phase blowing oxygen only from above through a top lance onto the surface of the molten high-carbon ferromanganese, and blowing an inert stirring gas into the melt below its surface, (b) in a subsequent reduction phase adding to the melt a solid reducing agent and lumps of lime to recover the slagged manganese, and (c) adding to the melt material of approximately the same composition as the melt to cool the melt to casting temperature while continuing to blow inert stirring gas into the melt.

2. A process according to claim 1 characterized in that the high-carbon ferromanganese is blown at a blowing speed of 1.5 to 4.0 $Nm^3O_2$/min per tonne of high-carbon ferromanganese.

3. A process according to claim 1 characterized in that in the oxidation phase the quantity of stirring gas is between 0.02 and 0.50 $Nm^3$/min per tonne of high-carbon ferromanganese.

4. A process according to claim 1 characterized in that in the reduction and cooling phase the quantity of stirring gas is between 0.05 and 0.50 $Nm^3$/min per tonne of high-carbon ferromanganese.

5. A process according to claim 1 characterized in that in the oxidation phase nitrogen, argon, carbon dioxide or waste gases, and in the reduction phase argon or nitrogen are blown into the melt as stirring gas.

6. A process according to claim 1 characterized in that in the reduction phase 10 to 15 kg of silicon or aluminium per tonne of high-carbon ferromanganese is added in the form of silicomanganese, ferrosilicon, silicon, aluminium or their alloys and, depending on the silicon content of the high-carbon ferromanganese, between 10 and 40 kg of lime are added per tonne of high-carbon ferromanganese.

7. A process according to claim 1 characterized in that both during and following the oxidation phase, manganese ore or filter dusts separated during the process are added for cooling.

8. A process according to claim 7 characterized in that during the reduction phase the reducing agents are added to reduce the slagged manganese and the manganese ore.

9. A process according to claim 1 characterized in that 40 to 350 kg of refined ferromanganese are added to the cooling phase per tonne of high-carbon ferromanganese.

10. A process according to claim 9 characterized in that manganese ore or filter dusts separated during the process are partly or wholly substituted for the refined ferromanganese added in the cooling phase.

11. A process according to claim 1 characterized in that dolomite and/or magnesite in quantities of up to 40 kg/tonne of high-carbon ferromanganese are added as additional slag formers in the cooling phase.

12. A water-cooled oxygen top blowing lance for the performance of the process according to claim 1, characterized by 3 to 10 nozzle apertures at the lance tip.

13. A water-cooled oxygen top blowing lance according to claim 12, characterized by 4 to 6 nozzle apertures at the lance tip.

14. A converter for the melting metallurgy treatment of metal melts, more particularly for the preparation of low-carbon and low-silicon ferromanganese according to one of claim 1, characterized in that 2 to 20 bottom tuyeres for the blowing-in of stirring gas are disposed in its base.

15. A converter according to claim 14 characterized in that 6 to 10 bottom tuyeres are disposed in the converter base.

16. A converter according to claim 14 characterized in that the bottom tuyeres are disposed in the centre of the converter base in a row parallel with the axis of rotation of the converter.

17. A converter according to claim 14 characterized in that the bottom tuyeres are completely disposed in that part of the converter which is free from melt and slag when the converter is turned over.

18. A converter according to claim 16 characterized in that the internal diameter of the bottom tuyeres is 3 to 12 mm.

19. A converter according to claim 18 characterized in that the internal diameter of the bottom tuyeres is 7 to 9 mm.

* * * * *